US009957448B2

(12) United States Patent
Gornay et al.

(10) Patent No.: US 9,957,448 B2
(45) Date of Patent: May 1, 2018

(54) PROCESS FOR PRODUCING A GASOLINE WITH A LOW SULPHUR AND MERCAPTANS CONTENT

(71) Applicant: IFP Energies nouvelles, Rueil-Malmaison (FR)

(72) Inventors: Julien Gornay, Les Cotes D'Arcy (FR); Philibert LeFlaive, Le Domaine de Chanteclair (FR); Annick Pucci, Croissy sur Seine (FR); Olivier Touzalin, Lyons (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 867 days.

(21) Appl. No.: 14/306,628

(22) Filed: Jun. 17, 2014

(65) Prior Publication Data

US 2014/0374315 A1 Dec. 25, 2014

(30) Foreign Application Priority Data

Jun. 19, 2013 (FR) ..... 13 55749
Apr. 28, 2014 (FR) ..... 14 53795

(51) Int. Cl.
*C10G 45/04* (2006.01)
*C10G 65/04* (2006.01)
*C10G 67/02* (2006.01)

(52) U.S. Cl.
CPC ..... *C10G 45/04* (2013.01); *C10G 65/04* (2013.01); *C10G 67/02* (2013.01)

(58) Field of Classification Search
CPC ..... C10G 45/04; C10G 65/04; C10G 67/02; B01J 21/04; B01J 23/24; B01J 23/28; B01J 23/74; B01J 23/755; B01J 23/76; B01J 23/84; B01J 23/85
See application file for complete search history.

(56) References Cited

U.S. PATENT DOCUMENTS 6,972,086 B2 12/2005 Didillon et al.
7,291,258 B2 11/2007 Podrebarac et al.
7,799,210 B2 9/2010 Dysard et al.
2002/0002315 A1* 1/2002 Kelly ..... C07C 7/163 585/259
2003/0209467 A1 11/2003 Didillon et al.
(Continued)

OTHER PUBLICATIONS

Search Report for FR1355749 dated Feb. 28, 2014.

*Primary Examiner* — Renee Robinson
*Assistant Examiner* — Derek N Mueller
(74) *Attorney, Agent, or Firm* — Millen White Zelano and Branigan, PC; Csaba Henter

(57) ABSTRACT

The present application concerns a process for the treatment of a gasoline containing sulphur-containing compounds and olefins, with the following steps:

a) a step for hydrodesulphurization of said gasoline in order to produce an effluent which is depleted in sulphur by passing the gasoline mixed with hydrogen over at least one hydrodesulphurization catalyst;
b) a step for separating the partially desulphurized gasoline from the hydrogen introduced in excess as well as the $H_2S$ formed during step a);
c) a catalytic step for sweetening desulphurized gasoline obtained from step b), which converts residual mercaptans into thioethers via an addition reaction with the olefins.

23 Claims, 4 Drawing Sheets

(56) References Cited

U.S. PATENT DOCUMENTS

| | | | | |
|---|---|---|---|---|
| 2004/0129606 | A1 | 7/2004 | Podrebarac et al. | |
| 2004/0195151 | A1* | 10/2004 | Podrebarac | C10G 65/02 208/210 |
| 2005/0252831 | A1 | 11/2005 | Dysard et al. | |
| 2006/0065578 | A1 | 3/2006 | Podrebarac et al. | |
| 2007/0114156 | A1 | 5/2007 | Greeley et al. | |
| 2007/0187297 | A1* | 8/2007 | Bouchy | B01J 23/002 208/208 R |

* cited by examiner

PROCESS FOR PRODUCING A GASOLINE WITH A LOW SULPHUR AND MERCAPTANS CONTENT

The present invention relates to a process for the production of gasoline with a low sulphur and mercaptans content.

PRIOR ART

The production of gasolines satisfying new environmental standards requires that their sulphur content be substantially reduced.

Converted gasolines, and more particularly those obtained from catalytic cracking, which may represent 30% to 50% of the gasoline pool, are known to have high mono-olefin and sulphur contents.

For this reason, about 90% of the sulphur present in the gasolines can be attributed to gasolines obtained from catalytic cracking processes, which will hereinafter be termed FCC (fluid catalytic cracking) gasolines. Thus, FCC gasolines constitute the preferred feed for the process of the present invention.

Possible pathways to the production of fuels with a low sulphur content which have been extensively used consist of specifically treating sulphur-rich gasoline bases using catalytic hydrodesulphurization processes carried out in the presence of hydrogen. Traditional processes desulphurize the gasolines in a non-selective manner by hydrogenating a large proportion of the mono-olefins, which causes a large drop in the octane number and a high hydrogen consumption. The latest processes, such as the Prime G+ process (trade mark), can be used to desulphurize cracked gasolines which are rich in olefins while limiting hydrogenation of the mono-olefins and as a consequence, limiting the resulting drop in the octane number and the high hydrogen consumption. Processes of that type are described in patent applications EP 1 077 247 and EP 1 174 485, for example.

The residual sulphur-containing compounds generally present in the desulphurized gasoline can be separated into two distinct families: unconverted sulphur-containing compounds present in the feed on the one hand, and the sulphur-containing compounds formed in the reactor by secondary reactions known as recombination reactions. In this latter family of sulphur-containing compounds, the predominant compounds are the mercaptans obtained by the addition of the $H_2S$ formed in the reactor to the mono-olefins present in the feed. Mercaptans with chemical formula R—SH, where R is an alkyl group, are also known as recombination mercaptans and generally represent between 20% and 80% by weight of residual sulphur in the desulphurized gasolines.

Obtaining a gasoline with a very low sulphur content, typically containing less than 10 ppm by weight as required in Europe, thus requires the elimination of at least a portion of the recombination mercaptans. This reduction in the quantity of recombination mercaptans can be carried out by catalytic hydrodesulphurization, but this involves hydrogenation of a large proportion of the mono-olefins present in the gasoline, which then results in a large reduction in the octane number of the gasoline as well as over-consumption of hydrogen.

In order to limit these disadvantages, various solutions have been described in the literature in order to desulphurize cracked gasolines by combining the steps of hydrodesulphurization and recombination mercaptans elimination by means of a technique which is carefully selected to avoid hydrogenation of the mono-olefins present, in order to preserve the octane number (see, for example, U.S. Pat. No. 7,799,210, U.S. Pat. No. 6,960,291, U.S. Pat. No. 6,387,249 and US 2007114156).

However, it appears that while those combinations using a final step for elimination of the recombination mercaptans are particularly suitable when a very low sulphur content is required, these may turn out to be very expensive when the quantity of mercaptans to be eliminated is high; high adsorbent or solvent consumptions are unavoidable, for example. Such a situation may in particular arise when the admissible mercaptans content in the gasoline pool is substantially lower than the total sulphur specifications, which is the case in many countries, in particular in Asia. The sulphur present in the form of mercaptans or in the form of hydrogen sulphide ($H_2S$) in the fuels may, in addition to causing problems with toxicity and odour, generate an attack on many of the metallic and non-metallic materials present in the distribution systems. Thus, specifications in almost all countries as regards mercaptans in fuels are very low (typically less than 10 ppm RSH (measurement of the mercaptans content using potentiometry, ASTM D 3227 method), including the case in which the total sulphur specification is relatively high, for example between 50 and 500 ppm by weight. Other countries have adopted a "Doctor Test" measurement in order to quantify mercaptans using a negative specification which has to be satisfied (ASTM D4952-12 method).

Thus, in some cases, it appears that because it is the most difficult to achieve without impairing the octane number, the most restrictive specification is the mercaptans specification rather than the total sulphur specification.

One aim of the present invention is to propose a process for the treatment of a gasoline containing sulphur, a portion of which is in the form of mercaptans, which can be used to reduce the mercaptans content of said hydrocarbon fraction while limiting the octane number loss as much as possible along with the consumption of reagents such as hydrogen or extraction solvents.

SUMMARY OF THE INVENTION

The invention provides a process for the treatment of a gasoline containing sulphur-containing compounds and olefins, the process comprising at least the following steps:

a) bringing the gasoline, hydrogen and a hydrodesulphurization catalyst into contact in at least one reactor at a temperature in the range 200° C. to 400° C., at a pressure in the range 0.5 to 5 MPa, with an hourly space velocity in the range 0.5 to 20 $h^{-1}$ and a ratio between the flow rate of hydrogen, expressed in normal $m^3$ per hour, and the flow rate of the feed to be treated, expressed in $m^3$ per hour under standard conditions, in the range 50 $Nm^3/m^3$ to 1000 $Nm^3/m^3$, in order to convert at least a portion of the sulphur-containing compounds into $H_2S$;

b) carrying out a step for separating the $H_2S$ which is formed and present in the effluent obtained from step a).

c) bringing the $H_2S$-depleted effluent obtained from step b) into contact, in a reactor, with a catalyst containing at least one sulphide of at least one transition metal or lead deposited on a porous support;

step c) being carried out at a temperature in the range 30° C. to 250° C., with a liquid hourly space velocity in the range 0.5 to 10 $h^{-1}$, a pressure in the range 0.4 to 5 MPa and with a $H_2$/feed ratio in the range 0 to 25 $Nm^3$ of hydrogen per $m^3$ of feed, in order to produce a gasoline obtained from step c) with a reduced mercaptans content compared with that of the effluent obtained from step b).

It has in fact surprisingly been shown that using a catalyst and specific operating conditions downstream of a gasoline hydrodesulphurization reactor can result in sufficient conversion of recombination mercaptans, which are generally less reactive compounds into compounds of the thioether type by reaction with the olefins. Thus, demercaptanization step c), which can also be termed the non-desulphurizing sweetening step, can be used to produce a gasoline with a low mercaptans content specification without necessitating a severe, expensive hydrodesulphurizing finishing step.

A further advantage of the process of the invention arises from the fact that it can be used to obtain a very low mercaptans content (for example less than 10 ppm by weight) in the final desulphurized gasoline with operating conditions for the hydrodesulphurization step (step a) which are much less severe (for example a greater reduction in the operating temperature and/or pressure), which has the effect of limiting the octane number loss, increasing the service life of the catalyst for the hydrodesulphurization step and also reducing the energy consumption.

Preferably, the transition metal of the catalyst of step c) is selected from a metal from group VIB, a metal from group VIII and copper, used alone or as a mixture.

In accordance with a preferred embodiment, the catalyst of step c) comprises:

- a support constituted by gamma or delta alumina with a specific surface area in the range 70 $m^2/g$ to 350 $m^2/g$;
- a quantity of the oxide of a metal from group VIB in the range 1% to 30% by weight with respect to the total catalyst weight;
- a quantity of the oxide of a metal from group VIII in the range 1% to 30% by weight with respect to the total catalyst weight;
- a percentage sulphurization of the constituent metals of said catalyst of at least 60%;
- a molar ratio between the metal from group VIII and the metal from group VIB in the range 0.6 to 3 mol/mol.

Preferably, the metal from group VIII is nickel and the metal from group VIB is molybdenum.

In accordance with one embodiment, the catalyst of step c) comprises:

- a support constituted solely by gamma alumina with a specific surface area in the range 180 $m^2/g$ to 270 $m^2/g$;
- a quantity by weight of nickel oxide in the range 4% to 12% by weight with respect to the total catalyst weight;
- a quantity by weight of molybdenum oxide in the range 6% to 18% by weight with respect to the total catalyst weight;
- a nickel/molybdenum molar ratio in the range 1 to 2.5 mol/mol; and
- a percentage sulphurization of the constituent metals of said catalyst of more than 80%.

The process of the invention may comprise a step in which the effluent obtained from step b) is mixed with a hydrocarbon cut selected from a LPG (liquefied petroleum gas) cut, a gasoline cut obtained from crude oil distillation, a pyrolysis unit, a cokefaction unit, a hydrocracking unit, or a unit for oligomerization, and an olefinic $C_4$ cut, and the mixture is treated in step c). In a preferred variation in which the effluent obtained from step b) is treated as a mixture with an olefinic $C_4$ cut, the effluent obtained from step c) is fractionated so as to separate an unreacted olefinic $C_4$ cut and said unreacted olefinic $C_4$ cut is recycled to the reactor for step c). In this preferred embodiment, the effluent obtained from step b) is mixed with an olefinic $C_4$ cut in order to promote the reaction for the addition of mercaptans to olefins in the sweetening reactor. Advantageously, the effluent obtained from sweetening step c) is fractionated so as to separate a cut containing $C_4$ olefins which have not reacted, and said olefinic $C_4$ cut is recycled to the sweetening reactor.

Alternatively, before step a), a step for distillation of the gasoline is carried out in order to fractionate said gasoline into at least two gasoline cuts, light and heavy, and the heavy gasoline cut is treated in steps a), b) and c).

In accordance with another embodiment, the effluent obtained from step b) is mixed with the light gasoline cut obtained from distillation so as to produce a mixture, and said mixture is treated in step c).

In the context of the invention, it is also possible to carry out, before step a), a step for distillation of the gasoline in order to fractionate said gasoline into at least two gasoline cuts, light and heavy, the heavy gasoline cut is treated in step a), the light gasoline cut is mixed with the effluent obtained from step a) so as to produce a mixture and said mixture is treated in steps b) and c).

Preferably, in the context of the embodiments described above, the mixture with the light gasoline cuts contains up to 50% by volume of the light gasoline cut.

In accordance with another embodiment of the process, before step a), a step for distillation of the gasoline is carried out so as to fractionate said gasoline into at least three gasoline cuts, respectively light, intermediate and heavy, and then the intermediate gasoline cut is treated in step a) then step b) and step c). In this embodiment, the heavy gasoline cut obtained from distillation is advantageously treated in a hydrodesulphurization step in a dedicated unit and then undergoes a step for sweetening of mercaptans after eliminating the $H_2S$. The step for sweetening the heavy desulphurized gasoline cut may be carried out either in a dedicated reactor or in the same sweetening reactor as that which treats the intermediate gasoline cut (the intermediate and heavy cuts are treated as a mixture in the sweetening reactor).

Before step a) and before any optional distillation step, it is also possible to bring the gasoline into contact with hydrogen and a selective hydrogenation catalyst in order to selectively hydrogenate the diolefins contained in said gasoline into olefins. This step for selective hydrogenation of diolefins may be carried out in a catalytic distillation column equipped with a section comprising a selective hydrogenation catalyst.

In the context of the invention and alternatively, steps a) and/or c) may be carried out in reactors which are catalytic columns including at least one catalytic bed, in which both the catalytic reaction and separation of the gasoline into at least two cuts (or fractions) is carried out. In the case in which step a) is carried out in a catalytic column, the cuts obtained from the catalytic column are sent to step b) and c) separately or as a mixture in order to reduce the mercaptans content thereof. In accordance with another embodiment in which step a) is carried out in a catalytic column, only the light cut, withdrawn from the head of the catalytic column which concentrates the mercaptans, is sent to steps b) and c).

In accordance with a preferred embodiment, the process further comprises a step d) in which the effluent obtained from step c) is sent to a fractionation column and a gasoline cut with a low mercaptans content is separated from the head of the fractionation column and a hydrocarbon cut containing thioether compounds is separated from the bottom of the fractionation column.

Advantageously, steps c) and d) are carried out concomitantly in a catalytic distillation column comprising a bed of catalyst for step c).

Preferably, the catalyst for step a) contains at least one metal from group VIB and/or at least one metal from group VIII on a support with a specific surface area of less than 250 $m^2/g$, in which the quantity of metal from group VIII, expressed as the oxide, is in the range 0.5% to 15% by weight and the quantity of metal from group VIB, expressed as the oxide, is in the range 1.5% to 60% by weight with respect to the weight of the catalyst.

In accordance with a preferred embodiment, the catalyst for step a) comprises cobalt and molybdenum and the density of molybdenum, expressed as the ratio between said $MoO_3$ content by weight and the specific surface area of the catalyst, is more than $7\times10^{-4}$, preferably more than $12\times10^{-4}$ $g/m^2$.

Advantageously, step c) is carried out without adding hydrogen.

DETAILED DESCRIPTION OF THE INVENTION

Description of the Feed:

The invention concerns a process for the treatment of gasolines comprising any type of chemical family, in particular diolefins, mono-olefins and sulphur-containing compounds. In particular, the present invention is of application to the transformation of converted gasolines, and in particular gasolines deriving from catalytic cracking, fluid catalytic cracking (FCC), a cokefaction process, a visbreaking process or from a pyrolysis process. As an example, gasolines obtained from catalytic cracking units (FCC) on average contain between 0.5% and 5% by weight of diolefins, between 20% and 50% by weight of mono-olefins and between 10 ppm and 0.5% by weight of sulphur.

The treated gasoline generally has a boiling point of less than 350° C., preferably less than 300° C. and highly preferably less than 220° C. The feeds for which the process of the invention are applicable have a boiling point in the range 0° C. to 280° C., preferably in the range 30° C. to 250° C. The feeds may also contain hydrocarbons containing 3 or 4 carbon atoms.

Description of the Catalytic Hydrodesulphurization Step (Step a)

The hydrodesulphurization step is carried out to reduce the sulphur content of the gasoline to be treated by converting the sulphur-containing compounds to $H_2S$, which is then eliminated in step b). It is particularly necessary to carry it out when the feed to be desulphurized contains more than 100 ppm by weight of sulphur, and more generally more than 50 ppm by weight of sulphur.

The hydrodesulphurization step consists of bringing the gasoline to be treated into contact with hydrogen in one or more hydrodesulphurization reactors containing one or more catalysts which are suitable for carrying out hydrodesulphurization.

In a preferred embodiment of the invention, step a) is carried out with the aim of carrying out hydrodesulphurization in a selective manner, i.e. with a level of hydrogenation of the mono-olefins of less than 80%, preferably less than 70% and highly preferably less than 60%.

The pressure at which this step is carried out is generally in the range 0.5 MPa to 5 MPa, preferably in the range 1 MPa to 3 MPa. The temperature is generally in the range 200° C. to 400° C., preferably in the range 220° C. to 380° C. In the case in which the hydrodesulphurization step a) is carried out in a plurality of reactors in series, the mean temperature at which each reactor is operated is generally higher by at least 5° C., preferably by at least 10° C. and highly preferably by at least 30° C. than the operating temperature of the preceding reactor.

The quantity of catalyst employed in each reactor is generally such that the ratio between the flow rate of the gasoline to be treated, expressed in $m^3$ per hour under standard conditions, per $m^3$ of catalyst (also known as the hourly space velocity) is in the range 0.5 $h^{-1}$ to 20 $h^{-1}$, preferably in the range 1 $h^{-1}$ to 15 $h^{-1}$. Highly preferably, the hydrodesulphurization reactor is operated at an hourly space velocity in the range 2 $h^{-1}$ to 8 $h^{-1}$.

The hydrogen flow rate is generally such that the ratio between the flow rate of hydrogen, expressed in normal $m^3$ per hour ($Nm^3/h$), and the flow rate of the feed to be treated, expressed in $m^3$ per hour under standard conditions, is in the range 50 $Nm^3/m^3$ to 1000 $Nm^3/m^3$, preferably in the range 70 $Nm^3/m^3$ to 800 $Nm^3/m^3$.

The desulphurization level, which depends on the sulphur content of the feed to be treated, is generally more than 50%, preferably more than 70%, so that the product obtained from step a) contains less than 100 ppm by weight of sulphur, preferably less than 50 ppm by weight of sulphur.

In the optional case of a concatenation of catalysts, the process comprises a succession of hydrodesulphurization steps, such that the activity of the catalyst of a step n+1 is in the range 1% to 90% of the activity of the catalyst of step n, as taught in the document EP 1 612 255.

Any catalyst which is known to the skilled person which is capable of promoting reactions for the transformation of organic sulphur to $H_2S$ in the presence of hydrogen may be used in the context of the invention. However, in a particular embodiment of the invention, catalysts with good selectivity as regards hydrodesulphurization reactions compared with the olefin hydrogenation reactions are preferably used.

Preferably, the hydrodesulphurization catalyst of step a) generally contains at least one metal from group VIB and/or at least one metal from group VIII on a support (groups VIB and VIII of the CAS classification respectively correspond to metals from groups 6 and groups 8 to 10 of the IUPAC classification in the CRC Handbook of Chemistry and Physics, published by CRC press, editor in chief D. R. Lide, 81st edition, 2000-2001). The metal from group VIB is preferably molybdenum or tungsten and the metal from group VIII is preferably selected from nickel and cobalt. In a highly preferable embodiment, the catalyst of step a) comprises cobalt and molybdenum.

The quantity of metal from group VIII, expressed as the oxide, is generally in the range 0.5% to 15% by weight, preferably in the range 1% to 10% by weight with respect to the total catalyst weight. The quantity of metal from group VIB is generally in the range 1.5% to 60% by weight, preferably in the range 3% to 50% by weight with respect to the total catalyst weight.

The catalyst support is normally a porous solid such as, for example, an alumina, a silica-alumina, magnesia, silica or titanium oxide, used alone or as a mixture. Highly preferably, the support is essentially constituted by transition alumina, i.e. it comprises at least 51% by weight, preferably at least 60% by weight, highly preferably at least 80% by weight or even at least 90% by weight of transition alumina with respect to the total weight of the support. It may optionally be constituted solely by a transition alumina.

The hydrodesulphurization catalyst preferably has a specific surface area of less than 250 $m^2/g$, more preferably less than 230 $m^2/g$ and highly preferably less than 190 $m^2/g$.

In order to minimize hydrogenation of the olefins, it is advantageous to use a catalyst comprising molybdenum alone or as a mixture with nickel or cobalt and in which the density of the molybdenum, expressed as the ratio between said weight content of $MoO_3$ and the specific surface area of the catalyst, is more than $7\times10^{-4}$, preferably more than $12\times10^{-4}$ g/m$^2$. Highly preferably a catalyst is selected comprising cobalt and molybdenum, wherein the density of molybdenum, expressed as the ratio between said quantity by weight of $MoO_3$ and the specific surface area of the catalyst, is more than $7\times10^{-4}$, preferably more than $12\times10^{-4}$ g/m$^2$.

Advantageously, prior to sulphurization, the hydrodesulphurization catalyst has a mean pore diameter of more than 20 nm, preferably more than 25 nm, or even 30 nm and often in the range 20 to 140 nm, preferably in the range 20 to 100 nm, and highly preferably in the range 25 to 80 nm. The pore diameter is measured by mercury porosimetry in accordance with ASTM D 4284-92 with a wetting angle of 140°.

The metals are deposited on the support using any of the methods known to the skilled person such as, for example, dry impregnation, or excess impregnation of a solution containing the precursors of the metals. Said solution is selected so as to be able to dissolve the precursors of the metals in the desired concentrations. In the case of the synthesis of a CoMo catalyst, for example, the molybdenum precursor may be molybdenum oxide or ammonium heptamolybdate. Examples which may be cited for cobalt are cobalt nitrate, cobalt hydroxide and cobalt carbonate. The precursors are generally dissolved in a medium which can dissolve them in the desired concentrations. It may thus be an aqueous medium and/or an organic medium, depending on the case.

After introducing the metal or metals and optional shaping of the catalyst, in a first step the catalyst is activated. This activation may correspond either to calcining (oxidation) then reduction, or to direct reduction, or to calcining alone. The calcining step is generally carried out at temperatures of 100° C. to 600° C., preferably in the range 200° C. to 450° C., in a flow of air. The reduction step is carried out under conditions enabling at least a portion of the oxide forms of the base metal to be converted into metal. In general, it consists of treating the catalyst in a flow of hydrogen at a temperature which is preferably at least 300° C.

The catalyst is preferably used at least partially in its sulphurized form. The sulphur may be introduced before or after any activation step, i.e. calcining or reduction. Preferably, no steps for oxidation of the catalyst are carried out when the sulphur or a sulphur-containing compound was introduced onto the catalyst. Sulphur or a sulphur-containing compound may be introduced ex situ, i.e. outside the reactor where the process of the invention is carried out, or in situ, i.e. in the reactor used for the process of the invention. In this latter case, the catalyst is preferably sulphurized by passage of a feed containing at least one sulphur-containing compound which, once decomposed, results in fixing of sulphur onto the catalyst. This feed may be gaseous or liquid, for example hydrogen containing $H_2S$ or a liquid containing at least one sulphur-containing compound.

Preferably, the sulphur-containing compound is added to the catalyst ex situ. As an example, after the calcining step, a sulphur-containing compound may be introduced onto the catalyst, optionally in the presence of another compound. The catalyst is then dried, then transferred to the reactor acting to carry out the process of the invention. In this reactor, the catalyst is then treated in hydrogen in order to transform at least a portion of the principal metal into sulphide. A procedure which is particularly suitable for sulphurizing a catalyst is that described in the documents FR 2 708 596 and FR 2 708 597.

In an alternative embodiment, step a) is carried out in a catalytic distillation column provided with a section comprising a hydrodesulphurization catalyst, in which both the catalytic hydrodesulphurization reaction and separation of the gasoline into at least two cuts (or fractions) is carried out. Preferably, the catalytic distillation column comprises two beds of hydrodesulphurization catalyst and the feed is sent to the column between the two beds of catalyst.

Step for Separating Hydrogen and $H_2S$ (Step b)

This step is carried out in order to separate the excess hydrogen as well as the $H_2S$ formed during step a) from the effluent obtained from step a). Any method which is known to the skilled person may be envisaged.

In accordance with a first preferred embodiment, after hydrodesulphurization step a), the effluent is cooled to a temperature which is generally less than 80° C. and preferably less than 60° C. in order to condense the hydrocarbons. The gas and liquid phases are then separated in a separation drum. The liquid fraction which contains the desulphurized gasoline as well as a fraction of the dissolved $H_2S$ is sent to a stabilization column or debutanizer. This column separates an overhead cut essentially constituted by residual $H_2S$ and hydrocarbon compounds with a boiling point which is less than or equal to that of butane, and a bottom cut free of $H_2S$, termed stabilized gasoline, containing compounds with a boiling point which is higher than that of butane.

In a second preferred embodiment, after the condensation step, the liquid fraction which contains the desulphurized gasoline as well as a fraction of dissolved $H_2S$ is sent to a stripping section, while the gaseous fraction principally constituted by hydrogen and $H_2S$ is sent to a purification section. Stripping may be carried out by heating the hydrocarbon fraction, alone or with an injection of hydrogen or steam, in a distillation column in order to extract overhead light compounds which are entrained by dissolving in the liquid fraction, as well as residual dissolved $H_2S$. The temperature of the stripped gasoline recovered from the column bottom is generally in the range 120° C. to 250° C.

Step b) is preferably carried out so that the sulphur in the form of $H_2S$ remaining in the desulphurized gasoline before the demercaptanization (sweetening) step c) represents less than 30%, preferably less than 20% and more preferably less than 10% of the total sulphur present in the treated hydrocarbon fraction.

Step for Catalytic Sweetening of the Desulphurized Hydrocarbon Fraction Obtained from Step b) (Step c)

This step consists of transforming the sulphur-containing compounds from the mercaptans family into heavier thioether type sulphur-containing compounds. These mercaptans are essentially recombination mercaptans obtained from the reaction of $H_2S$ formed in step a) with the olefins of the gasoline.

The transformation reaction employed in this step c) consists of reacting mercaptans with olefins to form heavier sulphur-containing compounds of the thioether type. It should be noted that this step has to be distinguished from a "conventional" hydrodesulphurization step which is aimed at transforming sulphur-containing compounds into $H_2S$ in the presence of hydrogen.

This step can also be used to convert residual $H_2S$ which would not have been completely eliminated during step b) into thioether by reaction with the olefins present in the feed.

The demercaptanization (or sweetening) reaction is carried out on a catalyst containing at least one sulphide of at least one transition metal or lead, deposited on a porous support. This reaction is preferably carried out on a catalyst comprising at least one sulphide of a metal selected from group VIB, group VIII, copper and lead.

Highly preferably, the catalyst comprises at least one element from group VIII (groups 8, 9 and 10 of the periodic classification of the elements, Handbook of Chemistry and Physics, 76th edition, 1995-1996), at least one element from group VIB (group 6 of the periodic classification of the elements, Handbook of Chemistry and Physics, 76th edition, 1995-1996) and a support. The element from group VIII is preferably selected from nickel and cobalt, in particular nickel. The element from group VIB is preferably selected from molybdenum and tungsten, highly preferably molybdenum.

The support for the catalyst for step c) is preferably selected from alumina, nickel aluminate, silica, silicon carbide, or a mixture of these oxides. Preferably, alumina is used, more preferably pure alumina. Preferably, a support is used which has a total pore volume, measured by mercury porosimetry, in the range 0.4 to 1.4 $cm^3/g$, preferably in the range 0.5 to 1.3 $cm^3/g$. The specific surface area of the support is preferably in the range 70 $m^2/g$ to 350 $m^2/g$.

In a preferred variation, the support is a cubic gamma alumina or a delta alumina.

The catalyst employed in step c) preferably comprises:

- a support constituted by gamma or delta alumina with a specific surface area in the range 70 $m^2/g$ to 350 $m^2/g$;
- a quantity of the oxide of a metal from group VIB in the range 1% to 30% by weight with respect to the total catalyst weight;
- a quantity of the oxide of a metal from group VIII in the range 1% to 30% by weight with respect to the total catalyst weight;
- a percentage sulphurization of the constituent metals of said catalyst of at least 60%;
- a molar ratio between the metal from group VIII and the metal from group VIB in the range 0.6 to 3 mol/mol.

In particular, it has been discovered that the performances are improved when the catalyst for step c) has the following characteristics:

- a support constituted by gamma alumina with a specific surface area in the range 180 $m^2/g$ to 270 $m^2/g$;
- a quantity by weight of oxide of the element from group VIB in the oxide form in the range 4% to 20% by weight, preferably in the range 6% to 18% by weight with respect to the total catalyst weight;
- a quantity of the oxide of a metal from group VIII expressed in the oxide form in the range 3% to 15% by weight, preferably in the range 4% by weight to 12% by weight with respect to the total catalyst weight;
- the molar ratio between the non-noble metal from group VIII and the metal from group VIB is in the range 0.6 to 3 mol/mol, preferably in the range 1 to 2.5 mol/mol;
- a percentage sulphurization of the constituent metals of said catalyst of at least 60%.

In a highly preferred embodiment of the invention, step c) employs a catalyst containing a quantity by weight, with respect to the total catalyst weight, of nickel oxide (in the NiO form) in the range 4% to 12%, a quantity by weight, with respect to the total catalyst weight, of molybdenum oxide (in the $MoO_3$ form) in the range 6% to 18%, a nickel/molybdenum molar ratio in the range 1 to 2.5, the metals being deposited on a support constituted solely by gamma alumina with a specific surface area in the range 180 $m^2/g$ to 270 $m^2/g$ and a degree of sulphurization of the metals constituting the catalyst of more than 80%.

The catalyst for step c) may be prepared using any technique which is known to the skilled person, in particular by impregnation of metals onto the selected support.

After introducing the metals, and optional shaping of the catalyst, it undergoes an activation treatment. This treatment is generally intended to transform the molecular precursors of the elements into the oxide phase. In this case it is an oxidizing treatment, but simple drying of the catalyst may also be carried out. In the case of an oxidizing treatment, also known as calcining, this is generally carried out in air or in diluted oxygen, and the treatment temperature is generally in the range 200° C. to 550° C., preferably in the range 300° C. to 500° C.

After calcining, the metals deposited on the support are in the oxide form. In the case of nickel and molybdenum, the metals are principally in the form of $MoO_3$ and NiO. Before contact with the feed to be treated, the catalysts undergo a sulphurization step. Sulphurization is preferably carried out in a sulpho-reducing medium, i.e. in the presence of $H_2S$ and hydrogen, in order to transform the metallic oxides into sulphides such as, for example, $MoS_2$ and $Ni_3S_2$. Sulphurization is carried out by injecting a stream containing $H_2S$ and hydrogen onto the catalyst, or a sulphur-containing compound which is capable of decomposing into $H_2S$ in the presence of the catalyst and hydrogen. Polysulphides such as dimethyldisulphide (DMDS) are precursors of $H_2S$ which are routinely used to sulphurize catalysts. The temperature is adjusted so that the $H_2S$ reacts with the metallic oxides to form metallic sulphides. This sulphurization may be carried out in situ or ex situ (inside or outside the reactor) of the demercaptanization reactor, at a temperature in the range 200° C. to 600° C. and more preferably in the range 300° C. to 500° C.

Step c) for sweetening into mercaptans consists of bringing the gasoline which has been desulphurized, freed from at least a portion of the $H_2S$, into contact with the catalyst in the sulphide form. The demercaptanization reactions of the invention are characterized by a reaction of the mercaptans on the olefins via direct addition on the double bond to produce thioether type compounds with formula $R_1$—S—$R_2$, where $R_1$ and $R_2$ are alkyl radicals, which have a boiling point which is higher than that of the starting mercaptans.

This sweetening step may be carried out in the absence (without adding or supplementing with hydrogen) or in the presence of hydrogen supplied to the reactor. Preferably, it is carried out in the absence of the addition of hydrogen. When hydrogen is used, it is injected with the feed in a manner so as to maintain a hydrogenating surface quality on the catalyst which is appropriate for high conversions in demercaptanization. Typically, step c) operates with a $H_2$/feed ratio in the range 0 to 25 $Nm^3$ of hydrogen per $m^3$ of feed, preferably in the range 0 to 10 $Nm^3$ of hydrogen per $m^3$ of feed, highly preferably in the range 0 to 5 $Nm^3$ of hydrogen per $m^3$ of feed, and more preferably in the range 0 to 2 $Nm^3$ of hydrogen per $m^3$ of feed.

The whole of the feed is generally injected into the inlet of the reactor. However, in some cases it may be advantageous to inject a fraction or all of the feed between two consecutive catalytic beds placed in the reactor.

The gasoline to be treated is brought into contact with the catalyst at a temperature in the range 30° C. to 250° C., preferably in the range 60° C. to 220° C., and still more preferably in the range 90° C. to 200° C., with a liquid hourly space velocity (LHSV) in the range 0.5 $h^{-1}$ to 10 $h^{-1}$, the unit for the liquid hourly space velocity being in liters of feed per liter of catalyst per hour (L/L·h). The pressure is in the range 0.2 MPa to 5 MPa, preferably in the range 0.5 to 2 MPa and still more preferably in the range 0.6 to 1 MPa.

During this step c), the mercaptans which combine with the olefins of the feed to form thioether compounds typically contain 5 to 12 carbon atoms, and are more generally branched. By way of example, the mercaptans which may be contained in the feed for step c) are 2-methylhexane-2-thiol, 4-methylheptane-4-thiol, 2-ethylhexane-3-thiol or 2,2,4-trimethylpentane-4-thiol.

At the end of step c), the hydrocarbon fraction treated under the conditions cited above thus has a reduced mercaptans content (these latter have been converted into thioether compounds). Generally, the gasoline produced at the end of step c) contains less than 20 ppm by weight of mercaptans, preferably less than 10 ppm by weight, and still more preferably less than 5 ppm by weight. During this step c), which does not necessitate a makeup of hydrogen, the olefins are not or are only slightly hydrogenated, which means that the octane number of the effluent can be kept high at the outlet from step c). As a general rule, hydrogenation of the olefins is less than 2%.

Step for Fractionation of Sweetened Gasoline Obtained from Step c) (Optional Step d)

At the end of step c), the gasoline treated under the conditions cited above thus has a reduced mercaptans content. In fact, these latter have been converted into thioether type compounds with a molecular weight which is higher than that of the starting mercaptans.

In accordance with the invention and optionally, a step is carried out (step d) for fractionating the gasoline, sweetened of mercaptans, into at least one light cut and a heavy cut of hydrocarbons. This fractionation step is carried out under conditions such that the thioether type sulphur-containing compounds formed in step c) and optionally the heaviest and the most refractory residual mercaptans which have not reacted during step c) are concentrated in the heavy hydrocarbon cut. Preferably, the fractionation step is carried out such that the light cut of hydrocarbons with a low sulphur content, in particular mercaptans and sulphide compounds, has an end boiling point in the range 130° C. to 160° C. Clearly, it is possible for the skilled person to select the cut point (i.e. the end boiling point for the light hydrocarbon cut) as a function of the target sulphur content in said light hydrocarbon cut. Typically, the light gas cut has a mercaptans content of less than 10 ppm by weight, preferably less than 5 ppm by weight and still more preferably less than 1 ppm by weight, and a total sulphur content of less than 50 ppm by weight, preferably less than 20 ppm by weight and still more preferably less than 10 ppm by weight. The light hydrocarbon cut with a low sulphur and mercaptans content is advantageously sent to the refinery gasoline pool. The heavy hydrocarbon cut, which concentrates the sulphur-containing thioether type compounds and the mercaptans which are refractory to the addition reaction with olefins, is advantageously treated in a hydrodesulphurization unit which applies more severe hydrotreatment conditions (higher temperature, quantity of hydrogen used is higher) or is alternatively sent to the gas oil pool of the refinery.

It should be noted that the step for mercaptans-sweetening (step c) and for fractionation (step d) may be carried out simultaneously using a catalytic column equipped with a catalytic bed containing the sweetening catalyst. Preferably, the catalytic distillation column comprises two beds of sweetening catalyst and the feed is sent to the column between the two beds of catalyst.

Layouts which can be Employed in the Context of the Invention

Various layouts may be employed in order to produce a desulphurized gasoline with a reduced mercaptans content, at low cost. The choice of optimized layout depends in fact on the characteristics of the gasolines to be treated and produced, as well as on the constraints on each refinery.

The layouts described below are given by way of illustration in a non-limiting manner.

In a first variation, the catalytic sweetening step c) may be carried out directly in series with the separation step b). In particular, in the case in which separation step b) is carried out at a temperature which is compatible with the temperature at which the catalytic sweetening step c) is carried out, the effluent obtained from step b) is sent directly to step c). It may also be envisaged that the temperature between steps b) and c) could be adjusted using heat exchange equipment.

In a second variation, before the catalytic sweetening step c), gasoline obtained from step b) is mixed with a LPG (liquid petroleum gas) cut or another gasoline cut containing sulphur such as, for example, gasolines from the distillation of crude oil, gasolines obtained from any cracking process, such as gasolines obtained from pyrolysis, cokefaction or hydrocracking processes, or a gasoline obtained from an oligomerization unit, and then the mixture in step c) is treated. It is also possible to treat the gasoline obtained from step b) in sweetening step c) mixed with an olefinic $C_4$ hydrocarbon cut in order to promote the catalytic addition reaction of the mercaptans (recombination) with the olefins.

In a third variation, a step for distillation of the gasoline to be treated is carried out in order to separate two cuts (or fractions), namely a light cut and a heavy cut, and the heavy cut is treated in accordance with the process of the invention. Thus, in a first embodiment, the heavy cut is treated by hydrodesulphurization (step a), then the $H_2S$ formed present in the heavy hydrodesulphurized cut (step b) is separated out, then the light cut (obtained from distillation) is mixed with the heavy cut obtained from step b) and finally, the mixture is treated in step c). Alternatively, in a second embodiment of the third variation, the light cut is mixed with the heavy hydrodesulphurized cut obtained from step a), and the mixture obtained is treated in step b) and c). This third variation has the advantage of not hydrotreating the light cut, which is rich in olefins and generally depleted in sulphur, which means that the loss of octane number by olefin hydrogenation can be limited. Preferably, in this third variation, the feed treated in step c) is constituted by all of the heavy desulphurized cut and a portion in the range 0 to 50% by volume of the light cut. In the context of this third variation, the light cut has a boiling point range of less than 100° C. and the heavy cut has a temperature range of more than 65° C.

In a fourth variation, the gasoline is distilled into two cuts: a first light cut and a first heavy hydrocarbon cut. The first light cut has a boiling point in the range between the initial boiling point of the gasoline to be treated and a final boiling point located between 140° C. and 160° C. The first light hydrocarbon cut is then treated by hydrodesulphurization (step a), then the $H_2S$ formed is separated from the hydrodesulphurized effluent (step b), the mercaptans in the hydrodesulphurized effluent are sweetened (step c) and the mercaptans-sweetened effluent is fractionated (step d) so as to produce a second light gasoline cut (with a boiling point in the range between the initial boiling point of the gasoline to be treated and a final boiling point of 140° C. or less) with a low mercaptans and thioethers content and a second heavy hydrocarbon cut containing the unconverted thioethers and mercaptans. Optionally, the first and second heavy hydrocarbon cuts may be mixed and treated by hydrodesulphurization in a dedicated unit.

In a fifth variation, the gasoline is distilled into three hydrocarbon cuts, light, intermediate and heavy, using one or more distillation columns. The light hydrocarbon cut preferably has a boiling point in the range from the initial boiling point of the gasoline to be treated and a final boiling point between 50° C. and 90° C. A light hydrocarbon cut of this type generally contains little sulphur and thus can be upgraded directly into the gasoline pool of the refinery. The intermediate hydrocarbon cut which has a boiling point range which is generally in the range 50° C. to 140° C. or 160° C., is treated by hydrodesulphurization (step a), then the $H_2S$ formed is separated from the hydrodesulphurized effluent (step b), the hydrodesulphurized effluent is sweetened of mercaptans (step c) and the mercaptans-sweetened effluent is fractionated (step d) so as to produce a second intermediate gasoline cut with a low mercaptans and thioethers content and a second heavy hydrocarbon cut containing unconverted thioethers and mercaptans. Optionally, the first and second heavy hydrocarbon cuts may be mixed and treated by hydrodesulphurization in a dedicated unit.

In a sixth variation, the gasoline to be treated initially undergoes a preliminary step consisting of selective hydrogenation of the diolefins present in the feed, as described in the patent application EP 1 077 247. The selectively hydrogenated gasoline is then distilled into at least two hydrocarbon cuts or into three hydrocarbon cuts, a light cut, an intermediate cut and a heavy cut. In the case of fractionation into two hydrocarbon cuts, the steps described above in the case of the third and fourth variations are applicable. In the case of fractionation into three hydrocarbon cuts, the intermediate cut is treated separately in a hydrodesulphurization step (step a), then a step for separating $H_2S$ (step b) and then a sweetening step (step c). Optionally, the effluent obtained from step c) undergoes a fractionation step d) so as to produce a second intermediate gasoline cut with a low mercaptans and thioethers content and a second heavy hydrocarbon cut containing the unconverted thioethers and mercaptans. Optionally, the second heavy hydrocarbon cut is mixed with the heavy cut obtained from the distillation upstream of the hydrodesulphurization step and the mixture is treated by hydrodesulphurization in a dedicated unit.

It should be noted that it is possible to carry out the steps of hydrogenation of the diolefins and fractionation into two or three cuts simultaneously using a catalytic distillation column which includes a distillation column equipped with a catalytic bed.

In a seventh variation, step a) is carried out in a catalytic distillation column incorporating a bed of hydrodesulphurization catalyst which can simultaneously desulphurize the gasoline and separate it into two hydrocarbon cuts, light and heavy. The cuts produced are then sent to steps b) and c) separately or as a mixture. Alternatively, only the light gasoline cut obtained from the catalytic distillation column for hydrodesulphurization is treated in steps b) then c). In this case, the effluent from step c) may be fractionated into two hydrocarbon cuts in accordance with step d) described above. In this case again, the heavy cut obtained from the catalytic distillation column for hydrodesulphurization may be treated in a second hydrodesulphurization unit, alone or as a mixture with the heavy cut obtained from step d) for fractionation of the light gasoline cut obtained from the catalytic distillation column for hydrodesulphurization.

In the case in which step c) is carried out on a light cut, in order to improve the conversion of the mercaptans (recombination) into thioether during step c), a mixture of an olefinic $C_4$ cut is advantageously produced upstream of step c) with the light gasoline so that step c) is advantageously carried out on a mixture containing the light hydrocarbon cut and an olefinic $C_4$ cut and not the light cut alone. At the end of step c), the effluent which is sweetened of mercaptans is sent to a separation column which separates out an olefinic $C_4$ cut and a light cut which is sweetened of mercaptans. The olefinic $C_4$ cut withdrawn from the separation column is advantageously recycled to the reactor for step c).

In the case in which step c) is carried out on an intermediate or heavy cut, in order to improve the conversion of the mercaptans (recombination) into thioether during step c), all or a portion of the light gasoline is advantageously added to the intermediate or heavy cut upstream of step c) so that step c) is advantageously carried out on a mixture containing olefins supplied by the light hydrocarbon cut.

Of all of the possible variations, the following two variations are those which are preferred:

1—The gasoline is distilled into two cuts (or fractions), a light cut (or fraction) and a heavy cut (or fraction), and only the heavy cut is treated in the hydrodesulphurization step a) and in step b) for separating $H_2S$ where the desulphurized gasoline is stabilized. After any adjustment of the temperature between steps b) and c), using heat exchange devices, the stabilized heavy fraction is then treated in sweetening step c) in the absence of hydrogen. The advantage of this particular modus operandum is to limit the investment required as far as possible while producing a gasoline which is sweetened in mercaptans which does not necessitate subsequent treatment before sending it to the gas pool.

2—The gasoline is distilled into two cuts (or fractions), a light cut (or fraction) and a heavy cut (or fraction), and only the heavy cut is treated in the hydrodesulphurization step a) and in step b) for separating $H_2S$ where the desulphurized gasoline is stabilized or simply freed of $H_2S$ by stripping. The feed treated in step c), with or without the addition of hydrogen, comprises all of the desulphurized heavy fraction and a portion in the range 10% to 50% by volume of the light cut. The effluent obtained from step c) is then stabilized in a step similar to step b). The advantage of this particular modus operandum is to maximize conversion of mercaptans during step c) by using an olefin-rich light cut in order to favour the mercaptans to thioethers conversion reaction.

BRIEF DESCRIPTION OF DRAWINGS

Further characteristics and advantages of the invention will become apparent from the following description given solely by way of non-limiting illustration, made with reference to the accompanying figures in which:

In the figures, similar elements are generally designated by identical reference numerals.

Referring to FIG. 1 and in a first embodiment of the process of the invention, gasoline to be treated is sent via the line 1 and hydrogen is sent via the line 3 to a hydrodesulphurization unit 2. The treated gasoline is generally a cracked gasoline, preferably a catalytically cracked gasoline. The gasoline is characterized by a boiling point which is typically in the range 30° C. to 220° C. As an example, the hydrodesulphurization unit 2 is a reactor containing a fixed bed or fluidized bed hydrodesulphurization catalyst (HDS); preferably, a fixed bed reactor is used. The reactor is operated under operating conditions and in the presence of a HDS catalyst as described above to decompose the sulphur-containing compounds and to form hydrogen sulphide ($H_2S$). Thus, an effluent (gasoline) containing $H_2S$ is withdrawn from said hydrodesulphurization reactor 2 via the line 4. Next, the effluent undergoes a $H_2S$ elimination step (step b) which, in the embodiment of FIG. 1, consists of treating the effluent in a stabilization column 5 in order to separate a stream containing $C_4^-$ hydrocarbons, the majority of the $H_2S$ and unreacted hydrogen overhead via the line 6, and a gasoline known as stabilized gasoline from the bottom of the column.

The stabilized gasoline is sent via the line 7 to a sweetening reactor 8 (step c) in order to reduce the quantity of mercaptans in the stabilized gasoline. The mercaptans contained in this stabilized gasoline are mainly recombination mercaptans obtained from the reaction of $H_2S$ on olefins. As discussed above, the sweetening reactor uses a catalyst which can bring about the addition reaction of mercaptans on the olefins via direct addition across the double bond to produce thioether type compounds with formula $R_1$—S—$R_2$ with $R_1$ and $R_2$ being alkyl radicals, with a higher molecular weight than that of the starting mercaptan. The reaction for the catalytic conversion of the mercaptans may optionally be carried out in the presence of hydrogen supplied via the line 9.

Figure 1:
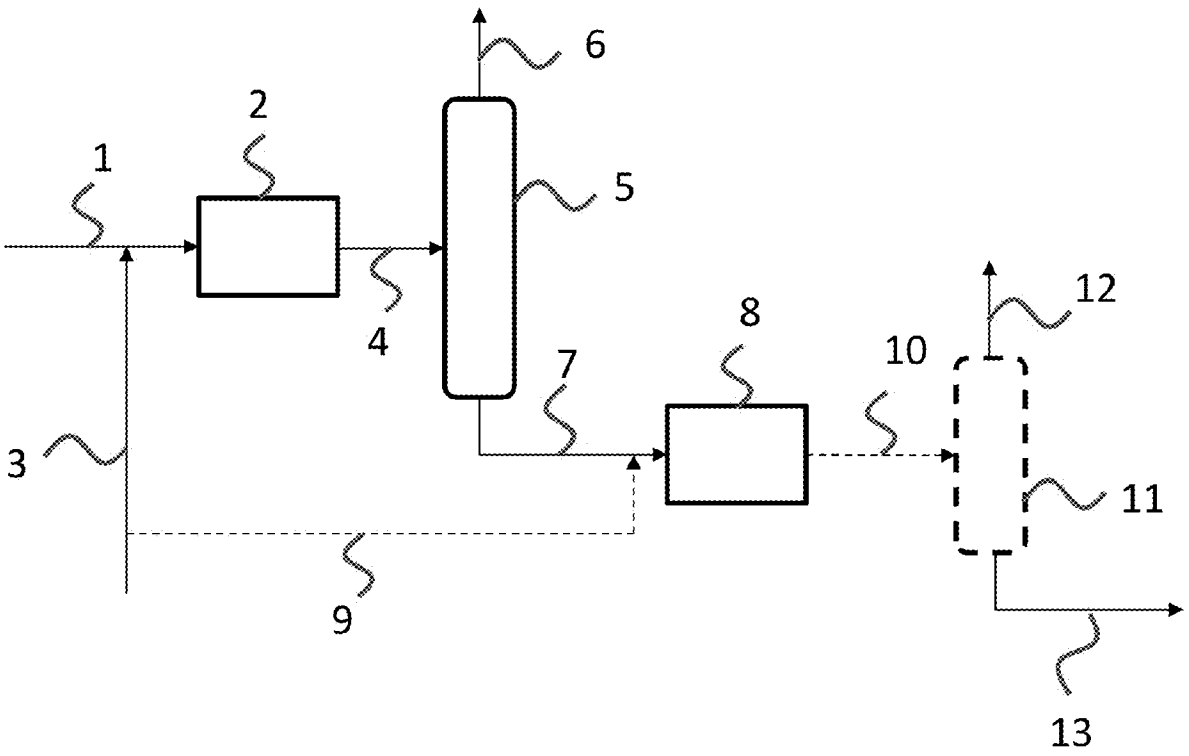
FIG. 1 is a layout of a process in accordance with the invention in accordance with a first embodiment.

As indicated in FIG. 1, the stabilized mercaptans-sweetened gasoline withdrawn via line 10 of the reactor 8 is advantageously sent to a separation column 11 which is designed and operated in order to separate overhead (via line 12) a stabilized light gasoline with a boiling point range which is preferably in the range 30° C. to 160° C. or in the range 30° C. to 140° C. and which has total mercaptans and sulphur contents which are respectively less than 10 ppm by weight and 50 ppm by weight. At the bottom of the separation column 11, a heavy gasoline is recovered via line 13 which contains the thioether type compounds formed in the sweetening reactor 8. The light gasoline is sent to the gasoline pool, while the heavy gasoline is either hydrodesulphurized in a dedicated hydrotreatment unit or sent to the diesel pool or distillate pool of the refinery.

Figure 2:
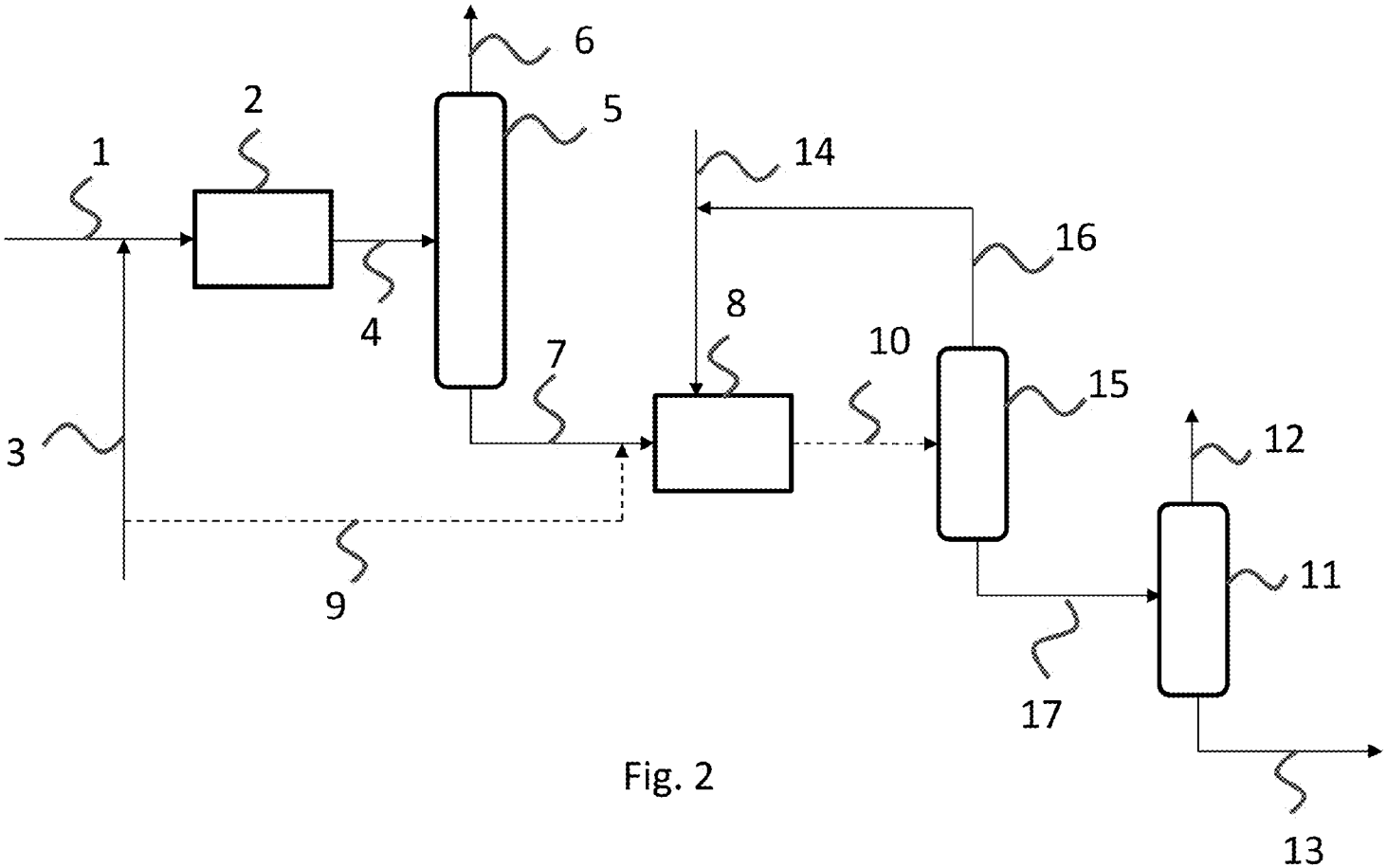
FIG. 2 is a layout of a process in accordance with the invention in accordance with a second embodiment.

FIG. 2 represents a second embodiment, based on that of FIG. 1, but differing in the fact that the stabilized gasoline is treated in the mercaptans-sweetening reactor 8 in the presence of an olefinic hydrocarbon cut, preferably an olefinic $C_4$ cut, supplied via the line 14. The aim of adding this olefinic cut is to favour the addition reaction of the mercaptans with the olefins by supplying the reaction medium with reactive olefins. As indicated in FIG. 2, the effluent obtained from the sweetening reactor is sent to a separation column 15 so as to recover the fraction of the olefinic cut which has not reacted in the sweetening reactor 8. If the olefinic cut is a $C_4$ cut, the separation column 15 employed is equivalent to a debutanizer, which separates a $C_4$ cut from the head of the column 15 which is recycled to the sweetening reactor 8 via the line 16. The cut 17 recovered from the bottom of the column 15 is fractionated in the column 11 as described in the context of FIG. 1 in order to provide a light gasoline cut which is low in sulphur and mercaptans via the line 12 and a heavy gasoline cut containing the thioether compounds formed in the sweetening reactor 8.

Figure 3:
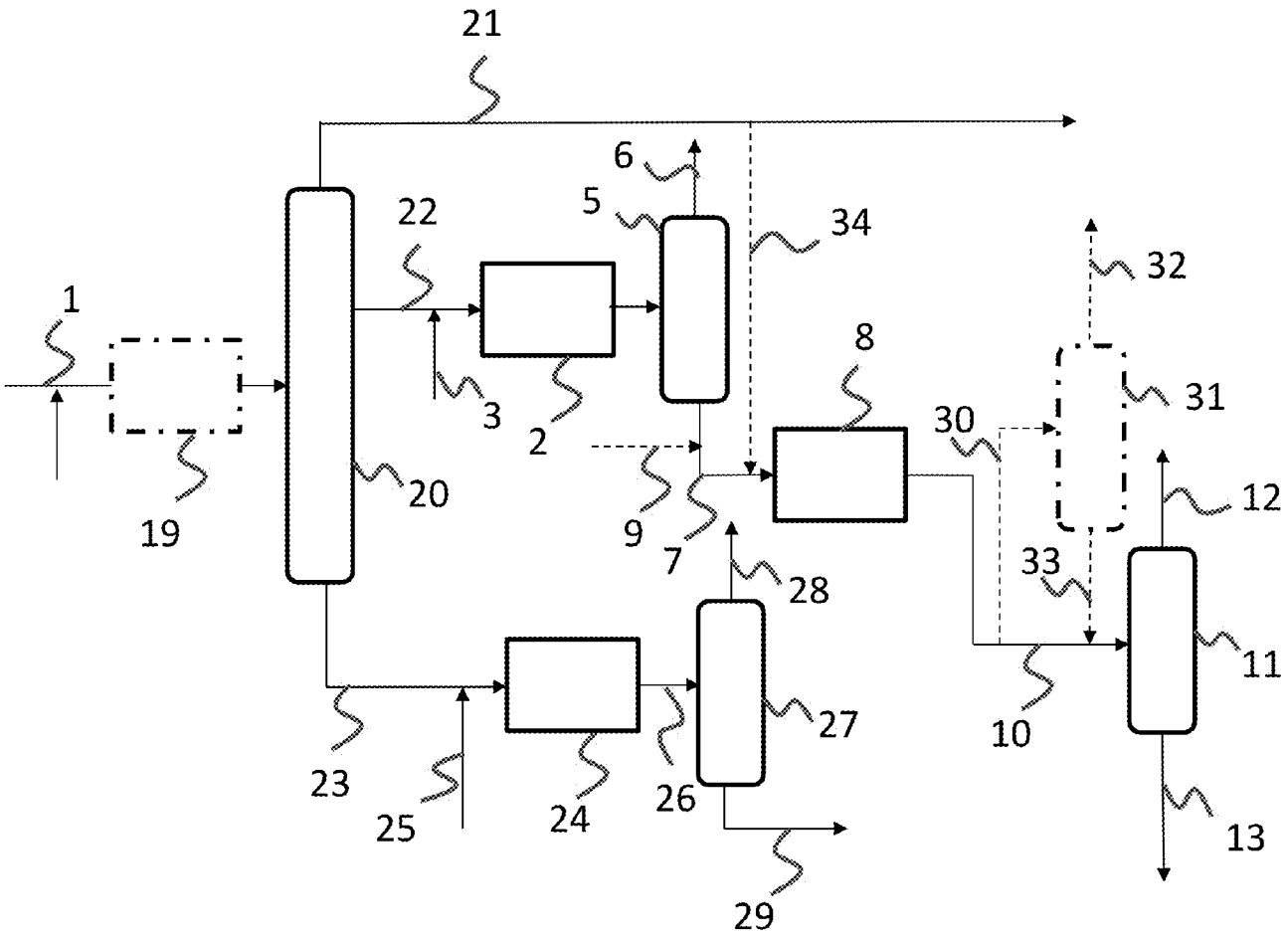
FIG. 3 represents a layout of an alternative process in accordance with a third embodiment.

FIG. 3 illustrates a third embodiment of the process of the invention. The gasoline feed to be treated, which typically comprises hydrocarbons boiling between 30° C. and 220° C., is initially sent to a distillation column 20 configured to fractionate the gasoline feed into three cuts. An overhead cut comprising compounds which are lighter than butane and including butane is withdrawn via the line 21. An intermediate cut comprising hydrocarbons containing 6 to 7 or 6 to 8 carbon atoms is recovered via line 22. Finally, a bottom cut, constituted by hydrocarbons containing more than 7 or 8 carbon atoms, is withdrawn via the line 23.

It should also be noted that before being fractionated, the gasoline feed is advantageously pre-treated in a reactor 19 for selective hydrogenation of diolefins to olefins. This catalytic reaction is preferably operated under the conditions and in the presence of a catalyst such as those described in documents EP 1 445 299 or EP 1 800 750.

Referring to FIG. 3, the bottom cut is treated in a hydrodesulphurization reactor 24 in the presence of hydrogen (supplied via the line 25) and a hydrodesulphurization catalyst as described above. Desulphurized effluent is withdrawn from the reactor 24 via the line 26 and sent to an $H_2S$ separation unit 27, such as a stripping column, for example, from which a gaseous fraction essentially containing $H_2S$ and hydrogen is separated via the line 28 and a bottom cut with a low sulphur content is separated via the line 29.

As indicated in FIG. 3, the intermediate gasoline cut is treated using the process of the invention. Thus, the intermediate gasoline cut is sent to a hydrodesulphurization reactor 2 via the line 22 for desulphurization therein in the presence of hydrogen supplied via the line 3. The effluent obtained from reactor 2 is freed from the $H_2S$ formed during the HDS step in a separation unit 5. The intermediate gasoline, depleted in $H_2S$, is sent via the line 7, optionally with hydrogen supplied via the line 9, to a mercaptans-sweetening reactor 8. In order to improve the conversion of mercaptans into thioether compounds by addition onto olefins, it is possible to supply light olefinic compounds contained in the overhead cut 21 to the sweetening reactor 8 via the line 34. The intermediate gasoline cut which has been sweetened of mercaptans is sent via line 10 to a fractionation column 11 operated so as to separate an intermediate gasoline cut with a low mercaptans and sulphur content and an intermediate bottom cut in which the thioether compounds produced during the sweetening step are concentrated. The intermediate gasoline cut with a low mercaptans and sulphur content is evacuated to the gasoline pool of the refinery via the line 12, while the intermediate bottom cut evacuated via the line 13 is either desulphurized in a hydrotreatment unit (for example a gas oil hydrodesulphurization unit) or sent directly to the gas oil pool of the refinery. As also represented in FIG. 3, it is possible to stabilize the hydrocarbon effluent obtained from the sweetening reactor 8 by treating it in a stabilization column (or debutanizer) 31 from which a light hydrocarbon fraction containing 4 or fewer carbon atoms is separated overhead and a stabilized intermediate gasoline cut which is sweetened of mercaptans is separated from the bottom and sent to the fractionation column 11 via the line 33. Advantageously, the intermediate bottom cut 13 may be desulphurized in the hydrodesulphurization reactor 24 as a mixture with the bottom cut 23 obtained from the first fractionation step carried out in the column 20.

Figure 4:
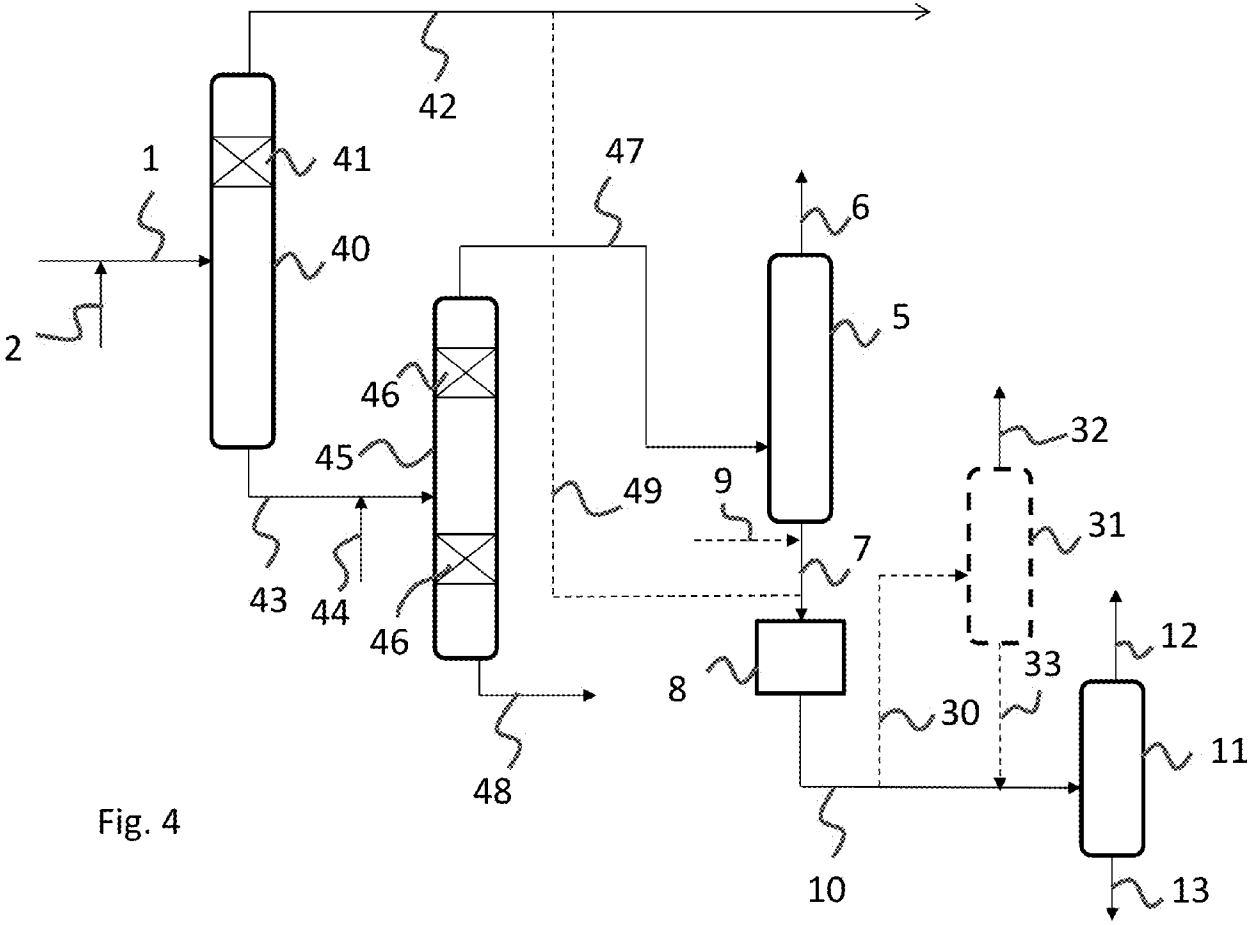
FIG. 4 represents a fourth embodiment of the process of the invention.

FIG. 4 discloses a fourth embodiment of the process of the invention using catalytic distillation columns.

The gasoline feed, for example a hydrocarbon cut boiling between 30° C. and 220° C. or between 30° C. and 160° C. or even between 30° C. and 140° C., is sent via the line 1 to a first catalytic distillation column 40 comprising a reaction section 41 containing a selective diolefin hydrogenation catalyst. The hydrogen required to carry out the hydrogenation reaction is supplied via the line 2. The modus operandum of the catalytic column 40 means that not only can the selective catalytic hydrogenation reaction be carried out, but also fractionation into a light hydrocarbon cut at the head of the column and a heavy hydrocarbon cut at the bottom of the column 40 can be carried out. Thus, the light hydrocarbon cut mixed with unreacted hydrogen is withdrawn via the line 42 and the heavy hydrocarbon cut is withdrawn via the line 43. The light cut is, for example, a $C_4^-$ cut and the heavy hydrocarbon cut is a cut boiling in the range ($C_5$-220° C.) or ($C_5$-160° C.) or ($C_5$-140° C.).

The heavy hydrocarbon cut is then treated in accordance with the process of the invention, which consists of a hydrodesulphurization step carried out in this embodiment in a catalytic distillation column 45 comprising two beds of hydrodesulphurization catalysts 46. Preferably, the heavy hydrocarbon cut is injected with hydrogen (via line 44) between the two beds of hydrodesulphurization catalysts 46. The catalytic distillation column 45 also allows to fractionate the heavy hydrocarbon cut into an intermediate overhead cut boiling in the range ($C_5$-140° C.) or ($C_5$-160° C.) and a bottom cut with a boiling point of more than 140° C. or 160° C. respectively. In accordance with the invention, in order to reduce the quantity of mercaptans in the intermediate cut, this latter is evacuated via the line 47 and undergoes a step for the elimination of $H_2S$ using the stabilization column 5 in order to separate, from the column via the line 6, an overhead stream containing the majority of the $H_2S$ and the stabilized intermediate cut from the bottom of the column via the line 7. This latter is treated in a sweetening reactor 8. The intermediate cut which has been sweetened of mercaptans obtained from the reactor 8 is then, via the line 10, fractionated in the column 11 in order to recover overhead (via the line 12) a gasoline with a low sulphur, mercaptans and thioethers content boiling in the range ($C_5$-140° C.) or ($C_5$-160° C.). The bottom cut which contains sulphides generally comprising at least 10 carbon atoms and more produced from the addition reaction of mercaptans to olefins is withdrawn via the line 13 from the bottom of the column 11. Optionally and as indicated in FIG. 4, the intermediate cut is treated in the sweetening reactor 8 as a mixture with the light hydrocarbon cut via the line 49, obtained from the head of the catalytic distillation column 40.

As indicated in FIG. 4, the intermediate cut sweetened in mercaptans obtained from reactor 8 may optionally undergo a stabilization step carried out in a stabilization column 31 from which a $C_4^-$ cut and an intermediate stabilized cut which is sweetened in mercaptans is respectively extracted from the head and from the bottom of said column 31. The stabilized intermediate cut which is sweetened in mercaptans is then sent to the fractionation column 11 via the line 33.

It should be noted that the mercaptans sweetening step and the fractionation can be carried out simultaneously using a catalytic column equipped with a catalytic bed containing the sweetening catalyst.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French Application No. 13/55.749, filed Jun. 19, 2014, and French Application No. 14/53.795 filed Apr. 28, 2014, are incorporated by reference herein.

Example 1 (Comparative)

A hydrodesulphurization catalyst A was obtained by "no excess solution" impregnation of a transition alumina in the form of beads with a specific surface area of 130 $m^2/g$ and a pore volume of 0.9 ml/g, with an aqueous solution containing molybdenum and cobalt in the form of ammonium heptamolybdate and cobalt nitrate respectively. The catalyst was then dried and calcined in air at 500° C. The cobalt and molybdenum contents in each sample was 3% by weight of CoO and 10% by weight of $MoO_3$.

50 ml of catalyst A was placed in a tubular fixed bed hydrodesulphurization reactor. The catalyst was initially sulphurized by treatment for 4 hours at a pressure of 3.4 MPa at 350° C., in contact with a feed constituted by 2% by weight of sulphur in the form of dimethyldisulphide in n-heptane.

The treated feed C1 was a catalytically cracked gasoline with an initial boiling point of 55° C., an end point of 242° C., with a MON of 79.8 and a RON of 89.5. Its sulphur content was 359 ppm by weight.

This feed was treated on catalyst A at a pressure of 2 MPa with a volume ratio of hydrogen to feed to be treated ($H_2$/HC) of 360 L/L and an hourly space velocity (HSV) of 4 $h^{-1}$. After treatment, the mixture of gasoline and hydrogen was cooled, the $H_2S$-rich hydrogen was separated from the liquid gasoline and the gasoline underwent a stripping treatment by injecting a stream of hydrogen in order to eliminate residual traces of dissolved $H_2S$ in the gasoline.

Table 1 shows the influence of temperature on the percentage desulphurization and on the octane number of catalyst A at a hydrodesulphurization temperature of 240° C. (A1) or 270° C. (A2).

TABLE 1

| Hydrodesulphurized gasoline | A1 | A2 |
|---|---|---|
| HDS temperature (° C.) | 240 | 270 |
| $H_2S$, ppm by weight | 0.5 | 0.5 |
| Mercaptans, ppm by weight (as S) | 24 | 11 |
| Total sulphur, ppm by weight | 86 | 19 |
| Total olefins, % by weight | 24.6 | 20.4 |
| Percentage desulphurization, % | 76.2 | 94.6 |
| Delta MON | 1.1 | 2.3 |
| Delta RON | 1.5 | 3.9 |

Hydrodesulphurization of the feed C1 with the catalyst A provided a reduction in the total sulphur content, but also in the mercaptans content. It should be noted that it was necessary to treat the feed at a temperature of at least 270° C. to obtain approximately 11 ppm by weight of mercaptans. This increase in the temperature of the hydrodesulphurization reaction had the effect of also favouring the olefins hydrogenation reaction, which resulted in a drop in the total olefins content in the hydrodesulphurized gasoline.

Example 2 (In Accordance with the Invention)

A catalyst B was obtained by impregnating a nickel aluminate with a specific surface area of 135 $m^2/g$ and a pore volume of 0.45 ml/g, using an aqueous solution containing molybdenum and nickel. The catalyst was then dried and calcined in air at 500° C. The nickel and molybdenum content of this sample was 7.9% by weight of NiO and 13% by weight of $MoO_3$.

The gasoline A1 as obtained and described in Example 1 was treated in the absence of hydrogen on demercaptanization catalyst B at a pressure of 1 MPa, a HSV of 3 $h^{-1}$ and a temperature of 100° C. After treatment, the gasoline B1 obtained was cooled.

Table 2 presents the principal characteristics of gasoline B1 obtained.

TABLE 2

| Reference of gasoline treated | B1 |
|---|---|
| $H_2S$, ppm by weight | 0 |
| Mercaptans, ppm by weight (as S) | 8 |
| Total sulphur, ppm by weight | 86 |
| Total olefins, % by weight | 24.6 |
| Demercaptanization, % | 67 |
| Olefins hydrogenation, % | 0 |

Thus, carrying out the demercaptanization step (step c) meant that the mercaptans of the gasoline A1 could be converted without hydrogen and without hydrogenating the olefins.

Example 3 (In Accordance with the Invention)

A catalyst D was obtained by impregnation of an alumina with a specific surface area of 239 $m^2/g$ and a pore volume of 0.6 ml/g, using an aqueous solution containing molybdenum and nickel. The catalyst was then dried and calcined in air at 500° C. The nickel and molybdenum content of this sample was 9.5% by weight of NiO and 13% by weight of $MoO_3$.

The gasoline A1 as obtained and described in Example 1 was mixed with a feed C2 to obtain a feed C3. Feed C2 was a light cracked gasoline which had undergone selective hydrogenation of diolefins and which had an initial boiling point of 22° C. and an end point of 71° C. with a MON or 82.5 and a RON of 96.9. Its sulphur content was 20 ppm by weight, its mercaptans content was less than 3 ppm by weight and its olefins content was 56.7% by weight.

Feed C3 was obtained by mixing 80% by weight of gasoline A1 with 20% by weight of feed C2. The mixture obtained was a gasoline with an initial boiling point of 22° C. and an end point of 242° C. Its sulphur content was 73 ppm, its mercaptans content was 19 ppm by weight and its olefins content was 31% by weight.

Feed C3 was treated in the presence of hydrogen on the demercaptanization catalyst D at a pressure of 1 MPa, an hourly space velocity of 3 $h^{-1}$ and with a volume ratio of hydrogen to the feed to be treated ($H_2$/HC) of 2 L/L and at a temperature of 100° C. After treatment, the gasoline mixture was cooled so as to recover a gas phase which was rich in hydrogen and $H_2S$ and a liquid gasoline fraction. The liquid fraction underwent a stripping treatment by injecting a stream of hydrogen in order to eliminate any traces of $H_2S$ which might have been dissolved in the gasoline.

Table 3 presents the principal characteristics of gasoline D1 obtained after stripping.

| Reference of hydrodesulphurized gasoline | D1 |
|---|---|
| Temperature, ° C. | 100 |
| Mercaptans, ppm by weight | 4 |
| Total sulphur, ppm by weight | 73 |
| Total olefins, % by weight | 31 |
| Demercaptanization, % | 79 |
| Olefins hydrogenation, % | 0 |

The process can be used to reduce the mercaptans content of gasoline A1 by converting them selectively to thioethers without hydrogenation of the olefins and thus without a loss of octane number.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the treatment of a gasoline containing sulphur-containing compounds and olefins, the process comprising at least the following steps:

a) bringing the gasoline, hydrogen and a hydrodesulphurization catalyst into contact in at least one reactor at a temperature in the range of 200° C. to 400° C., at a pressure in the range of 0.5 to 5 MPa, at an hourly space velocity in the range of 0.5 to 20 $h^{-1}$ and with a ratio between the flow rate of hydrogen, expressed in normal $m^3$ per hour, and the flow rate of the feed to be treated, expressed in $m^3$ per hour under standard conditions, in the range of 50 $Nm^3/m^3$ to 1000 $Nm^3/m^3$, in order to convert at least a portion of the sulphur-containing compounds into $H_2S$ and to produce an effluent;

b) carrying out a step for separating the $H_2S$ which is formed and present in the effluent obtained from step a);

c) bringing the $H_2S$-depleted effluent obtained from step b) into contact, in a reactor, with a catalyst containing at least one sulphide of at least one transition metal or lead deposited on a porous support, step c) being carried out at a temperature in the range of 30° C. to 250° C., with a liquid hourly space velocity in the range of 0.5 to 10 $h^{-1}$, a pressure in the range of 0.2 to 5 MPa and with a $H_2$/feed ratio of 0 $Nm^3$ of hydrogen per $m^3$ of feed, wherein mercaptans and olefins are reacted and produce thioether compounds and produce a gasoline obtained from step c) with a reduced mercaptans content compared with that of the effluent obtained from step b).

2. The process according to claim 1, in which the transition metal of the catalyst for step c) is a metal from group VIB, a metal from group VIII or copper, alone or in a mixture.

3. The process according to claim 2, in which the catalyst for step c) comprises:

a support constituted by gamma or delta alumina with a specific surface area in the range of 70 $m^2/g$ to 350 $m^2/g$;

a quantity by weight of the oxide of a metal from group VIB in the range of 1% to 30% by weight with respect to the total catalyst weight;

a quantity by weight of the oxide of a metal from group VIII in the range of 1% to 30% by weight with respect to the total catalyst weight;

a percentage sulphurization of the constituent metals of said catalyst of at least 60%;

a molar ratio between the metal from group VIII and the metal from group VIB in the range of 0.6 to 3 mol/mol.

4. The process according to claim 2, in which the metal from group VIII is nickel and the metal from group VIB is molybdenum.

5. The process according to claim 4, in which the catalyst for step c) comprises:

a support constituted solely by gamma alumina with a specific surface area in the range of 180 $m^2/g$ to 270 $m^2/g$;

a quantity by weight of nickel oxide in the range of 4% to 12% by weight with respect to the total catalyst weight;

a quantity by weight of molybdenum oxide in the range of 6% to 18% by weight with respect to the total catalyst weight;

a nickel/molybdenum molar ratio in the range of 1 to 2.5 mol/mol; and a percentage sulphurization of the constituent metals of said catalyst of more than 80%.

6. The process according to claim 1, in which before step a), a step for distillation of the gasoline is carried out in order to fractionate said gasoline into at least two gasoline cuts, light and heavy, and the heavy gasoline cut is treated in steps a), b) and c).

7. The process according to claim 6, in which the effluent obtained from step b) is mixed with the light gasoline cut so as to produce a mixture, and said mixture is treated in step c).

8. The process according to claim 1, in which before step a), a step for distillation of the gasoline is carried out in order to fractionate said gasoline into at least two gasoline cuts, light and heavy, the heavy gasoline cut is treated in step a), the light gasoline cut is mixed with the effluent obtained from step a) so as to produce a mixture and said mixture is treated in steps b) and c).

9. The process according to claim 7, in which the mixture contains up to 50% by volume of the light gasoline cut.

10. The process according to claim 1, in which before step a), a step for distillation of the gasoline is carried out so as to fractionate said gasoline into at least three gasoline cuts, respectively light, intermediate and heavy, and then the intermediate gasoline cut is treated in step a) then step b) and step c).

11. The process according to claim 1, in which before step a) and before any optional distillation step, the gasoline is brought into contact with hydrogen and a selective hydrogenation catalyst in order to selectively hydrogenate diolefins contained in said gasoline into olefins.

12. The process according to claim 1, in which the catalyst for step a) contains at least one metal from group VIB and/or at least one metal from group VIII on a support with a specific surface area of less than 250 $m^2/g$, in which the quantity of metal from group VIII, expressed as the oxide, is in the range of 0.5% to 15% by weight and the quantity of metal from group VIB, expressed as the oxide, is in the range of 1.5% to 60% by weight with respect to the weight of the catalyst.

13. The process according to claim 12, in which the catalyst for step a) comprises cobalt and molybdenum and the density of molybdenum, expressed as the ratio between said $MoO_3$ content by weight and the specific surface area of the catalyst, is more than $7\times10^4$.

14. The process according to claim 1, in which step a) is carried out in a catalytic column which separates the gasoline into at least two gasoline cuts, light and heavy, and the light cut is treated in step b) and step c).

15. The process according to claim 1, further comprising a step d) in which the effluent obtained from step c) is sent to a fractionation column and a gasoline cut with a low mercaptans content is separated from the head of the fractionation column and a hydrocarbon cut containing thioether compounds is separated from the bottom of the fractionation column.

16. The process according to claim 15, in which steps c) and d) are carried out concomitantly in a catalytic distillation column comprising a bed of catalyst for step c).

17. The process according to claim 1, in which the effluent obtained from step b) is mixed with a hydrocarbon cut, which is a LPG cut, a gasoline cut obtained from crude oil distillation, a pyrolysis unit, a cokefaction unit, a hydrocracking unit or an oligomerization unit, or an olefinic $C_4$ cut, and the mixture is treated in step c).

18. A process for the treatment of a gasoline containing sulphur-containing compounds and olefins, the process comprising at least the following steps:

a) bringing the gasoline, hydrogen and a hydrodesulphurization catalyst into contact in at least one reactor at a temperature in the range of 200° C. to 400° C., at a pressure in the range of 0.5 to 5 MPa, at an hourly space velocity in the range of 0.5 to 20 $h^{-1}$ and with a ratio between the flow rate of hydrogen, expressed in normal $m^3$ per hour, and the flow rate of the feed to be treated, expressed in $m^3$ per hour under standard conditions, in the range of 50 $Nm^3/m^3$ to 1000 $Nm^3/m^3$, in order to convert at least a portion of the sulphur-containing compounds into $H_2S$ and to produce an effluent;

b) carrying out a step for separating the $H_2S$ which is formed and present in the effluent obtained from step a) and in which the effluent obtained is mixed with an olefinic $C_4$ cut;

c) bringing the $H_2S$-depleted effluent obtained from step b) into contact, in a reactor, with a catalyst containing at least one sulphide of at least one transition metal or lead deposited on a porous support, step c) being carried out at a temperature in the range of 30° C. to 250° C., with a liquid hourly space velocity in the range of 0.5 to 10 $h^{-1}$, a pressure in the range of 0.2 to 5 MPa and with a $H_2$/feed ratio in the range of 0 to 25 $Nm^3$ of hydrogen per $m^3$ of feed, in order to produce a gasoline obtained from step c) with a reduced mercaptans content compared with that of the effluent obtained from step b), and the effluent obtained is fractionated so as to separate an unreacted olefinic $C_4$ cut and said unreacted olefinic $C_4$ cut is recycled to the reactor for step c).

19. The process according to claim 18, in which before step a), a step for distillation of the gasoline is carried out in order to fractionate said gasoline into at least two gasoline cuts, light and heavy, and the heavy gasoline cut is treated in steps a), b) and c).

20. The process according to claim 18, in which before step a), a step for distillation of the gasoline is carried out so as to fractionate said gasoline into at least three gasoline cuts, respectively light, intermediate and heavy, and then the intermediate gasoline cut is treated in step a) then step b) and step c).

21. The process according to claim 18, in which before step a) and before any optional distillation step, the gasoline is brought into contact with hydrogen and a selective hydrogenation catalyst in order to selectively hydrogenate diolefins contained in said gasoline into olefins.

22. The process according to claim 18, in which step a) is carried out in a catalytic column which separates the gasoline into at least two gasoline cuts, light and heavy, and the light cut is treated in step b) and step c).

23. A process for the treatment of a gasoline containing sulphur-containing compounds and olefins, the process comprising at least the following steps:

a) bringing the gasoline, hydrogen and a hydrodesulphurization catalyst into contact in at least one reactor at a temperature in the range of 200° C. to 400° C., at a pressure in the range of 0.5 to 5 MPa, at an hourly space velocity in the range of 0.5 to 20 $h^{-1}$ and with a ratio between the flow rate of hydrogen, expressed in normal $m^3$ per hour, and the flow rate of the feed to be treated, expressed in $m^3$ per hour under standard conditions, in the range of 50 $Nm^3/m^3$ to 1000 $Nm^3/m^3$, in order to convert at least a portion of the sulphur-containing compounds into $H_2S$ and to produce an effluent;

b) carrying out a step for separating the $H_2S$ which is formed and present in the effluent obtained from step a);

wherein the resultant effluent is mixed with a hydrocarbon cut, which is an olefinic $C_4$ cut, providing an $H_2S$-depleted effluent mixture, c) bringing the $H_2S$-depleted effluent mixture into contact, in a reactor, with a catalyst containing at least one sulphide of at least one transition metal or lead deposited on a porous support, step c) being carried out at a temperature in the range of 30° C. to 250° C., with a liquid hourly space velocity in the range of 0.5 to 10 $h^{-1}$, a pressure in the range of 0.2 to 5 MPa and with a $H_2$/feed ratio in the range of 0 to 10 $Nm^3$ of hydrogen per $m^3$ of feed, wherein mercaptans and olefins are reacted and produce thioether compounds and produce a gasoline obtained from step c) with a reduced mercaptans content compared with that of the effluent obtained from step b), and wherein the effluent obtained from step c) is fractionated so as to separate an unreacted olefinic $C_4$ cut and said unreacted olefinic $C_4$ cut is recycled to the reactor for step c).

* * * * *